US012709373B2

(12) United States Patent
Linder et al.

(10) Patent No.: US 12,709,373 B2
(45) Date of Patent: Aug. 18, 2026

(54) METHOD OF CONTROLLING VESSEL, CONTROL SYSTEM AND VESSEL

(71) Applicant: ABB Schweiz AG, Baden (CH)

(72) Inventors: Jonas Linder, Mellerud (SE); Hamid Feyzmahdavian, Stockholm (SE); Kalevi Tervo, Helsinki (FI)

(73) Assignee: ABB SCHWEIZ AG, Baden (CH)

( * ) Notice: Subject to any disclaimer, the term of this patent is extended or adjusted under 35 U.S.C. 154(b) by 142 days.

(21) Appl. No.: 18/419,838

(22) Filed: Jan. 23, 2024

(65) Prior Publication Data

US 2024/0262482 A1 Aug. 8, 2024

(30) Foreign Application Priority Data

Jan. 31, 2023 (EP) ..... 23154246

(51) Int. Cl.
*B63H 25/04* (2006.01)
*B63H 25/42* (2006.01)

(52) U.S. Cl.
CPC ..... *B63H 25/04* (2013.01); *B63H 25/42* (2013.01)

(58) Field of Classification Search
None
See application file for complete search history.

(56) References Cited

U.S. PATENT DOCUMENTS

| | | | | |
|---|---|---|---|---|
| 7,422,497 | B1 * | 9/2008 | Wyant | B63H 21/213 440/2 |
| 8,478,464 | B2 * | 7/2013 | Arbuckle | B63H 21/22 701/300 |
| 2010/0126401 | A1 * | 5/2010 | Kokkinis | B63B 35/12 114/144 B |
| 2022/0017203 | A1 * | 1/2022 | Pedersen | B63H 25/42 |

FOREIGN PATENT DOCUMENTS

| | | | | |
|---|---|---|---|---|
| CN | 105301963 A | * | 2/2016 | |
| CN | 114217606 A | * | 3/2022 | G05D 1/0276 |
| WO | 2020098898 A1 | | 5/2020 | |
| WO | WO-2021074483 A1 | * | 4/2021 | B63H 25/42 |

OTHER PUBLICATIONS

Kongsberg Maritime As; "Kongsberg K-Pos DP (OS) Dynamic Positioning System, Operator Manual"; Norway; Oct. 30, 2007; 360 pages.*

European Office Action; Application No. 23154246.5; Completed: Apr. 11, 2025; 7 Pages.

Xiaocheng, Shi, et al.; "Optimizing Adaptive Thrust Allocation Based on Group Biasing Method for Ship Dynamic Positioning"; International Conference on Automation and Logistics (ICAL), IEEE; Chongqing, China; Aug. 15, 2011; 5 Pages.

Extended European Search Report; Application No. 23154246.5; Completed: Apr. 24, 2023; Issued: May 5, 2023; 11 Pages.

* cited by examiner

*Primary Examiner* — Hitesh Patel
*Assistant Examiner* — Elle Rose Knudson
(74) *Attorney, Agent, or Firm* — Greenberg Traurig, LLP

(57) ABSTRACT

A method of controlling a vessel having a plurality of thrusters, where the vessel is configured to operate in a bias mode where at least two of the thrusters provide thrust forces at least partly in opposite thrust directions, the method including estimating, by a control system, an operational condition associated with the vessel; and commanding, by the control system and based on the estimation, execution of a countermeasure associated with an activation of the bias mode, a deactivation of the bias mode or a change of a bias level of the bias mode. A control system and a vessel are also provided.

17 Claims, 4 Drawing Sheets

METHOD OF CONTROLLING VESSEL, CONTROL SYSTEM AND VESSEL

TECHNICAL FIELD

The present disclosure generally relates to control of vessels. In particular, a method of controlling a vessel comprising a plurality of thrusters, a control system for controlling a vessel, and a vessel comprising a control system, are provided.

BACKGROUND

A position of a marine vessel may be controlled using a plurality of thrusters, e.g., for station keeping where the vessel is held stationary. A high-level controller and an allocation controller may be implemented in a control system of the vessel. The high-level controller may calculate a target force and a target torque provided by the vessel to achieve a target motion of the vessel. The allocation controller may then determine a target thrust force and a target thrust direction of each individual thruster to obtain the target force and target torque of the vessel while optimizing an objective, such as reducing energy consumption and meeting constraints of the thrusters.

One type of conventional position control is herein referred to as a normal mode. In the normal mode, the allocation controller may control the thrusters such that the vessel achieves the target force and the target torque while minimizing power consumption. To this end, all thrusters typically point in the same, or substantially in the same, thrust direction. Small variations of an external force acting on the vessel can be compensated by varying thrust directions and thrust forces of the thrusters. In the normal mode, the task of the high-level controller may boil down to finding the target force and the target torque needed to counteract a substantially constant external force acting on the vessel in a primary direction. However, in some situations, an additional external force may act on the vessel in a direction different from the primary direction. One example is during station keeping of the vessel where external forces from waves act with varying magnitudes on the vessel in one direction and external forces from the wind act with varying magnitudes on the vessel in a different direction. In such situation, the thrusters may have to cycle between different thrust directions and thrust forces to compensate for the external disturbances. Due to limited turning rates and limited dynamics of the thrusters, such cycling may lead to a momentary loss in position. Moreover, such cycling of the thrusters increases wear and tear which may reduce the lifetime of the thrusters.

In order to mitigate the above problem and to improve the performance of the position control, the vessel may be controlled in a bias mode. In the bias mode, at least two of the thrusters provide thrust forces at least partly in opposite thrust directions.

A bias mode may be directional or non-directional, herein referred to as a directional bias mode and a non-directional bias mode, respectively. The directional bias mode can be used when large variations of magnitudes of an external force acting on the vessel in a primary direction are expected. In the directional bias mode, groups of thrusters act against each other in the primary direction. This typically leads to higher thrust forces in one or more first thrusters in the group to compensate for oppositely directed thrust forces from one or more second thrusters in the group. Variations of a magnitude of the external force are compensated by varying thrust forces. Since it is typically faster to, firstly, decrease a thrust force of a thruster than to increase the thrust force, and secondly, to change a thrust force at a higher propeller speed, the responsiveness of the vessel in the primary direction is increased in comparison with the normal mode. In the directional bias mode, variations of a direction of the external force are mainly compensated by varying thrust directions.

In the non-directional bias mode, the thrusters work against each other both in the primary direction and in a secondary direction, different from the primary direction, e.g., orthogonal to the primary direction. Variations of magnitudes and directions of any external forces acting on the vessel are mainly compensated by varying thrust forces, while thrust directions may be only slightly varied. The non-directional bias mode increases the responsiveness both in all directions in comparison with the normal mode.

Thus, if large variations of magnitudes of external forces in any direction are expected, the non-directional bias mode may be most suitable. If the one or more directions are unknown, the thrusters can be turned to be able to generate a target force on the vessel as quick as possible in any direction.

One problem associated with the use of non-directional bias mode in vessels today is that the non-directional bias mode is activated and deactivated manually by a human user. For example, when the human user perceives that the motion performance of the vessel is inadequate or when the human user requests high motion performance of the vessel, the human user manually activates the non-directional bias mode. If the activation is made too early or if the deactivation is made too late, energy consumption may be unnecessarily increased. Conversely, if the activation is made too late or if the deactivation is made too early, the motion performance of the vessel is deteriorated and the vessel may deviate from a target position or a target velocity. As a consequence, large compensations by the thrusters may be needed.

SUMMARY

One object of the invention is to provide an improved method of controlling a vessel comprising a plurality of thrusters.

A further object of the invention is to provide an improved control system for controlling a vessel.

A still further object of the invention is to provide an improved vessel.

These objects are achieved by the method according to appended claim 1, by the control system according to appended claim 10 and by the vessel according to appended claim 11.

The invention is based on the realization that by estimating an operational condition associated with the vessel, and by automatically commanding activation, deactivation or a change of a bias level of a bias mode based on the estimation, the bias mode can be used in an optimal way to increase motion performance and reduce energy consumption.

According to a first aspect, there is provided a method of controlling a vessel comprising a plurality of thrusters, where the vessel is configured to operate in a bias mode where at least two of the thrusters provide thrust forces at least partly in opposite thrust directions, the method comprising estimating, by a control system, an operational condition associated with the vessel; and commanding, by the control system and based on the estimation, execution of a countermeasure associated with an activation of the bias mode, a deactivation of the bias mode or a change of a bias level of the bias mode.

By using the control system to estimate the operational condition of the vessel and to command execution of the countermeasure based on the estimation, the execution of the countermeasure associated with the bias mode can be commanded automatically. For example, an activation of the bias mode, a deactivation of the bias mode and a change of the bias level can be performed automatically or a corresponding notification to a human user of the vessel can be issued automatically. As a consequence, the bias mode will be used, and will only be used, when necessary and with a suitable bias level. This is of great advantage in comparison with when a human user activates or deactivates the bias mode or changing a bias level of the bias mode based on a behavior of the vessel as perceived by the human user.

The method enables a rapid activation or deactivation of the bias mode at the right time. An excessive use of the bias mode leads to a higher energy consumption, such as fuel consumption, and an increased wear of the thrusters. An insufficient use of the bias mode leads to deteriorated motion performance of the vessel. The method generates an optimal use of the bias mode, which may be considered to be an optimal trade-off between energy consumption and motion performance. The method leads to an improved energy efficiency, an improved motion performance of the vessel, and reduced wear and tear of the thrusters in comparison with when activation or deactivation of the bias mode is handled purely manually. The improved motion performance of the vessel may comprise a reduced drift from a target position or a target velocity and/or less cyclic behavior. The improved motion performance of the vessel may also increase safety.

The counteracting thrust forces enable the vessel to react faster to changes in external disturbances in comparison with the normal mode. The bias mode thus increases the response of the vessel to changes in external disturbances. A relatively high bias level provides a higher response of the vessel to changes in external disturbances in comparison with a relatively low bias level. For a given operational condition, the at least partly opposite thrust forces may be higher at the relatively high bias level than at the relatively low bias level. Thus, the bias level may be associated with the thrust forces of one or more of the thrusters.

The bias mode may be used for motion control of the vessel, such as position control and velocity control. For example, the bias mode may be used to maintain the vessel at a target position or to maintain a target velocity of the vessel. The bias mode may be a directional bias mode or a non-directional bias mode as described herein. The directional bias mode and the non-directional bias mode may also be referred to as a primary bias mode and a secondary bias mode, respectively.

Two thrust forces provided at least partly in opposite direction may be angled at least 90 degrees and/or less than 270 degrees relative to each other in a horizontal plane. Throughout the present disclosure, each thruster may for example be an azimuthing thruster, a rotatable thruster, a fixed pitch propeller (FPP) thruster and/or a controllable pitch propeller (CPP) thruster. The vessel may for example comprise two, four, six or eight thrusters.

The operational condition may be a current operational condition, a historic operational condition and/or a future operational condition of the vessel. For example, the execution of a countermeasure associated with an activation of the bias mode may be commanded based on route data of the vessel, such as when the vessel enters a busy harbor or is about to stop or turn. Conversely, the execution of a countermeasure associated with a deactivation of the bias mode may be commanded when the vessel leaves a busy harbor or is no longer about to stop or turn. The operational condition may thus be estimated based on route data of the vessel, for example from a GPS (global positioning system) device. The vessel may also be provided with live traffic information for various locations and route data, for example from an AIS (automatic identification system) device. Such live traffic information and route data constitute examples of operational conditions of the vessel.

The method may further comprise evaluating, by the control system, the operational condition in view of the bias mode. In this case, the execution of the countermeasure may be commanded based on the evaluation.

The operational condition may be continuously or repeatedly evaluated. When the operational condition changes from not meeting a bias mode criterion to meeting a bias mode criterion, execution of the countermeasure associated with activation of the bias mode may be automatically commanded by the control system. Conversely, when the operational condition changes from meeting the bias mode criterion to not meeting the bias mode criterion, execution of the countermeasure associated with deactivation of the bias mode may be automatically commanded by the control system. Furthermore, when the operational condition changes from meeting a first bias mode criterion to meeting a second bias mode criterion, different from the first bias mode criterion, execution of the countermeasure associated with changing a bias level from a first bias level to a second bias level, different from the first bias level may be automatically commanded by the control system, and vice versa.

The estimation of the operational condition may comprise estimating at least one parameter of one or more external disturbances acting on the vessel. The at least one parameter of the one or more external disturbances may for example be estimated based on sensor data according to the present disclosure associated with the vessel, such as position data, velocity data, acceleration data and/or route data of the vessel.

The at least one parameter may comprise a direction, a variation of the direction, a magnitude and/or a variation of the magnitude.

Each external disturbance may comprise an external force. For example, the estimation of the operational condition may comprise estimating a variation of the direction of the external force and/or a variation of the magnitude of the external force. By knowing variations of the direction of the external force and/or variations of the magnitude of the external force, the countermeasure associated with the activation or the deactivation of the bias mode can more accurately be issued. Moreover, a bias level can be set more appropriately. By applying an appropriate amount of bias, the motion performance of the vessel is improved and the energy consumption is reduced.

For example, by knowing that the direction of a single external force is varied to a limited extent, such as a few degrees, the control system may command execution of the countermeasure associated with activation of the directional bias mode, rather than the non-directional bias mode. When the directional bias mode is activated in this condition, the energy consumption will be lower than in the non-directional bias mode for a set of given thrust forces while the directional bias mode still provides a satisfactory motion control of the vessel.

Alternatively, or in addition, the external disturbance may comprise an external torque.

The method may further comprise providing, by the control system, a model of the vessel. In this case, the estimation of the operational condition may be made using the model. The model may for example be a nonlinear model of the vessel describing the motion of the vessel in a horizontal plane.

As an alternative to using a model of the vessel, the bias level of the bias mode may be gradually increased or gradually decreased until a satisfactory motion performance is reached.

The method may further comprise receiving, by the control system, sensor data from one or more sensors. In this case, the estimation of the operational condition may be made using the sensor data.

The one or more sensors may for example comprise one or more position sensors providing sensor data in the form of position data indicative of a position of the vessel, one or more velocity sensors providing sensor data in the form of velocity data indicative of a velocity of the vessel, one or more acceleration sensors providing sensor data in the form of acceleration data indicative of an acceleration of the vessel, one or more image sensors providing sensor data in the form of image data of an environment surrounding the vessel (such as waves), one or more wind sensors providing sensor data in the form of wind data indicative of the wind acting on the vessel, one or more route sensors providing sensor data in the form of route data indicative of a route of the vessel, and one or more soft sensors providing sensor data in the form of soft sensor data indicative of several measurements of the vessel (e.g., the position, the velocity and/or the acceleration).

The method may further comprise storing the sensor data as historic sensor data. In this case, the estimation of the operational condition may be made using the historic sensor data. For example, by estimating the operational condition using historic position data of the vessel, changes of the position of the vessel over time can be used to estimate a direction, a magnitude and/or a variation of an external force acting on the vessel. Based on such estimated operational condition, activation or deactivation of the bias mode can be more accurately performed. Moreover, the bias level can be more accurately set.

The method may further comprise determining the bias level based on the operational condition. In this case, the countermeasure may comprise activating a control of the vessel in the bias mode at the determined bias level. When this variant is used in combination with the estimation of a direction and/or a magnitude of an external disturbance, the method in some situations enables use of less power for the thrusters. An increase and a decrease of the bias level may comprise an increase and a decrease, respectively, of the at least partly opposing thrust forces.

The countermeasure may comprise a notification to a human user of the vessel. In response to the notification, the human user may manually manipulate an input device to activate the bias mode, deactivate the bias mode, or change the bias level. The notification may be visual, audible or tactile, and may for example be provided by an output device in signal communication with the control system.

According to a second aspect, there is provided a control system for controlling a vessel comprising a plurality of thrusters, where the vessel is configured to operate in a bias mode where at least two of the thrusters provide thrust forces at least partly in opposite thrust directions, the control system comprising at least one data processing device and at least one memory having at least one computer program stored thereon, the at least one computer program comprising program code which, when executed by the at least one data processing device, causes the at least one data processing device to estimate an operational condition associated with the vessel; and command based on the estimation, execution of a countermeasure associated with an activation of the bias mode, a deactivation of the bias mode or a change of a bias level of the bias mode.

The at least one computer program may comprise program code which, when executed by the at least one data processing device, causes the at least one data processing device to perform, or command performance of, any step described herein, such as according to the first aspect. Features described in connection with the first aspect correspondingly apply to the second aspect, and vice versa.

The estimation of the operational condition may comprise estimating at least one parameter of one or more external disturbances acting on the vessel.

The at least one parameter may comprise a direction, a variation of the direction, a magnitude and/or a variation of the magnitude.

Each external disturbance may comprise an external force.

The at least one computer program may comprise program code which, when executed by the at least one data processing device, causes the at least one data processing device to provide a model of the vessel. In this case, the estimation of the operational condition may be made using the model.

The at least one computer program may comprise program code which, when executed by the at least one data processing device, causes the at least one data processing device to determine the bias level based on the operational condition. In this case, the countermeasure may comprise activating a control of the vessel in the bias mode at the determined bias level.

The countermeasure may comprise a notification to a human user of the vessel.

According to a third aspect, there is provided a vessel comprising the control system according to the second aspect, and the plurality of thrusters, wherein the vessel is configured to operate in the bias mode where at least two of the thrusters provide thrust forces at least partly in opposite thrust directions.

The vessel of the third aspect may be of any type as described in connection with the first or second aspects, and vice versa.

The vessel may further comprise one or more sensors arranged to provide sensor data to the control system. In this case, the estimation of the operational condition may be made using the sensor data.

The at least one computer program may comprise program code which, when executed by the at least one data processing device, causes the at least one data processing device to store the sensor data as historic sensor data. In this case, the estimation of the operational condition may be made using the historic sensor data.

BRIEF DESCRIPTION OF THE DRAWINGS

Further details, advantages and aspects of the present disclosure will become apparent from the following description taken in conjunction with the drawings, wherein.

DETAILED DESCRIPTION

Figure 1:
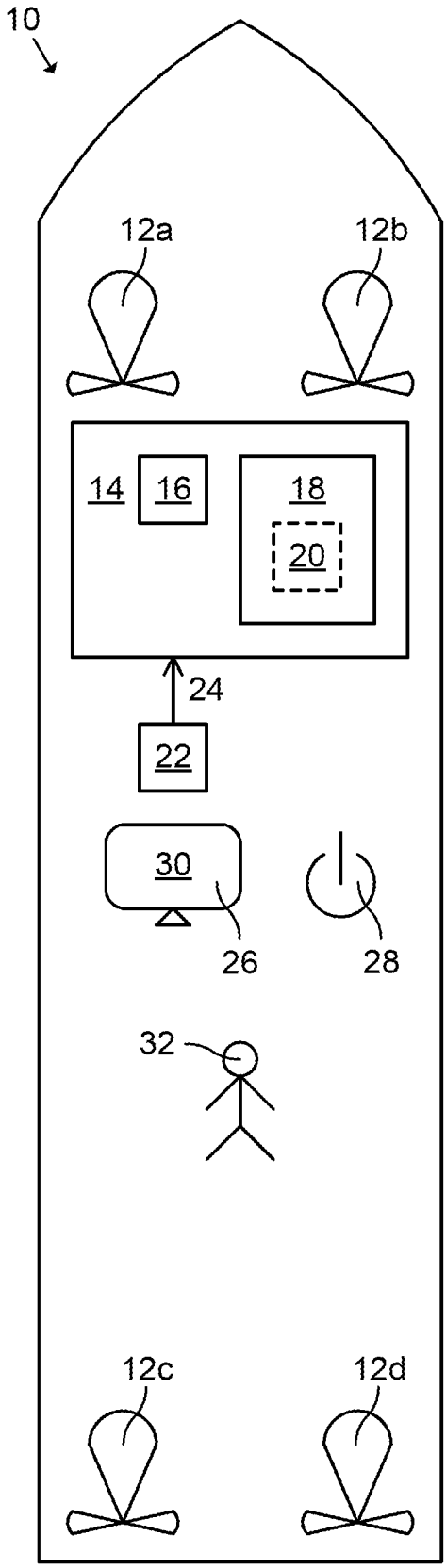
FIG. 1: schematically represents a top view of a vessel.

In the following, a method of controlling a vessel comprising a plurality of thrusters, a control system for controlling a vessel, and a vessel comprising a control system, will be described. The same or similar reference numerals will be used to denote the same or similar structural features.

FIG. 1 schematically represents a top view of a marine vessel 10. The vessel 10 may for example be a ship or a floating production storage and offloading (FPSO) unit. The vessel 10 comprises a plurality of thrusters, here a first thruster 12*a*, a second thruster 12*b*, a third thruster 12*c* and a fourth thruster 12*d*. One, several or all of the thrusters 12*a*-12*d* may also be referred to with reference numeral "12".

Each thruster 12 is rotatable in a horizontal plane (parallel with the drawing plane of FIG. 1) into different thrust directions. Each thruster 12 may comprise a propeller and an engine driving the propeller. By increasing an engine speed of the engine and hence a rotational speed of the propeller, the thrust force of the thruster 12 can be increased, and vice versa. The thrusters 12 are here exemplified as azimuthing thrusters. Each engine may for example be an internal combustion engine, such as a diesel engine, or an electric motor. In the latter case, the electric motor may be electrically powered by a power plant comprising one or more internal combustion engines.

The vessel 10 further comprises a control system 14. The control system 14 of this example comprises a data processing device 16 and a memory 18. The memory 18 has a computer program stored thereon. The computer program comprises program code which, when executed by the data processing device 16, causes the data processing device 16 to perform, or command performance of, various steps described herein.

As shown in FIG. 1, a model 20 of the vessel 10 is stored in the memory 18. The model 20 may for example be a nonlinear model of the vessel 10 describing the motion of the vessel 10 in the horizontal plane. The vessel 10 may comprise a rudder (not shown). The rudder may be included in the model 20.

The vessel 10 of this example further comprises one or more sensors, here exemplified as a position sensor 22. The position sensor 22 is arranged to provide position data 24 to the control system 14. The position data 24 is indicative of a position of the vessel 10 in the horizontal plane. The position sensor 22 may for example be a GPS device. The position data 24 is one example of sensor data according to the present disclosure. In this example, the control system 14 is configured to estimate an operational condition of the vessel 10 based on the position data 24. As mentioned above, the vessel 10 may use a wide range of sensors alternative to, or in addition to, the position sensor 22 to provide sensor data based on which the control system 14 can estimate the operational condition of the vessel 10.

The vessel 10 of this example further comprises an output device, here exemplified as a display 26, and an input device 28. The display 26 is configured to provide a visual notification 30 to a human user 32. The input device 28 can be manually operated by the human user 32.

Figure 2:
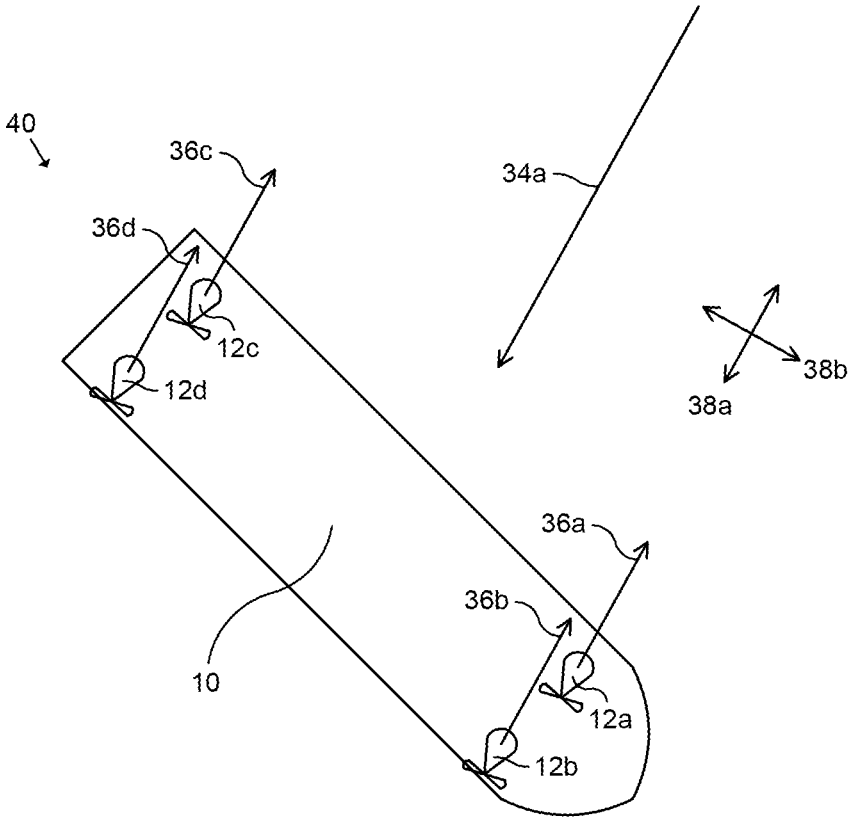
FIG. 2: schematically represents a top view of the vessel when operating in a normal mode.

FIG. 2 schematically represents a top view of the vessel 10. As shown, the vessel 10 is acted on by a substantially constant primary external force 34*a*, constituting one example of an operational condition according to the present disclosure. The primary external force 34*a* may for example be a force from wind or waves. The primary external force 34*a* is one example of an external disturbance according to the present disclosure.

The first thruster 12*a* provides a first thrust force 36*a*, the second thruster 12*b* provides a second thrust force 36*b*, the third thruster 12*c* provided a third thrust force 36*c*, and the fourth thruster 12*d* provided a fourth thrust force 36*d*. One, several or all of the thrust forces 36*a*-36*d* may also be referred to with reference numeral "36".

FIG. 2 further shows a primary reference direction 38*a* and a secondary reference direction 38*b*, here orthogonal to the primary reference direction 38*a*. In this example, the primary external force 34*a* has a primary direction in the primary reference direction 38*a*.

In FIG. 2, the vessel 10 operates in a normal mode 40 to keep the vessel 10 at a stationary position without rotation in the horizontal plane. In the normal mode 40, all thrusters 12 point in the same, or substantially in the same, thrust direction for minimum energy consumption, here parallel with the primary reference direction 38*a*. In FIG. 2, all thrusters 12 have the same thrust direction with respect to the vessel 10.

Based on the position data 24, the control system 14 calculates the thrust forces 36 and the thrust directions needed to keep the vessel 10 at the stationary position. In case a magnitude of the primary external force 34*a* is increased, the thrust forces 36 of the thrusters 12 may be increased, and vice versa, to avoid the vessel 10 leaving the stationary position. Small variations of the primary direction can be compensated by varying the thrust directions of the thrusters 12.

Figure 3:
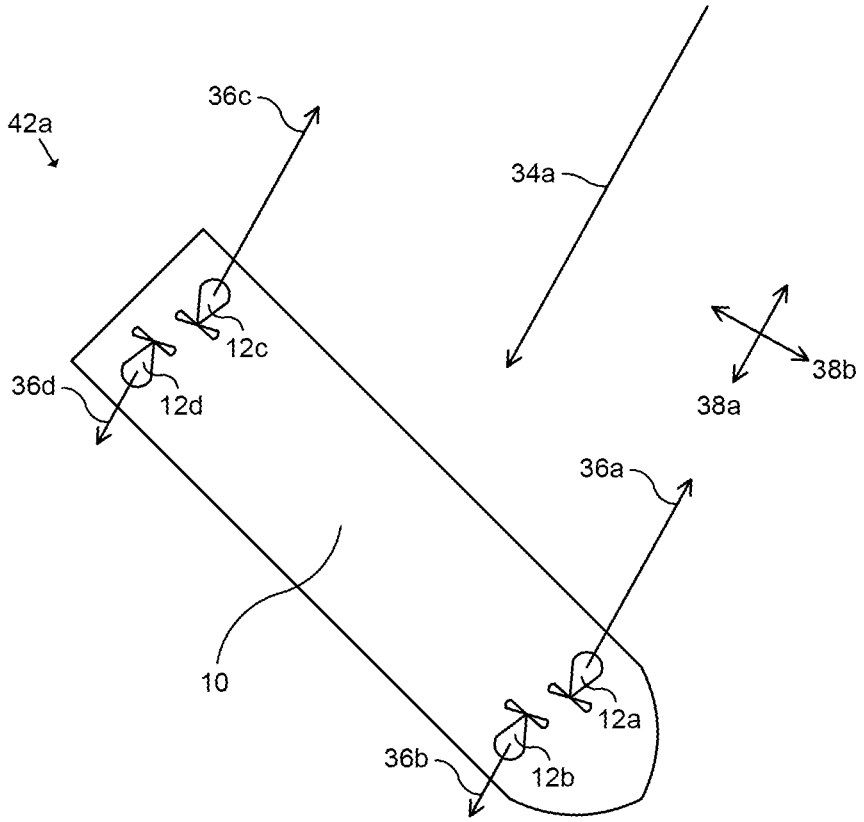
FIG. 3: schematically represents a top view of the vessel when operating in a directional bias mode.

FIG. 3 schematically represents a top view of the vessel 10 when operating in a directional bias mode 42*a*. The directional bias mode 42*a* is one example of a bias mode according to the present disclosure. In FIG. 3, a magnitude of the primary external force 34*a* varies. This circumstance constitutes a further example of an operational condition according to the present disclosure.

In the directional bias mode 42*a*, the thrusters 12 provide thrust forces 36 in opposite thrust directions, here in the primary reference direction 38*a*. Thus, the thrust forces 36 partly cancel out each other. This enables smoother loads on the engines. In this specific and non-limiting example, a second thrust direction of the second thruster 12*b* is opposite to a first thrust direction of the first thruster 12*a*, and a fourth thrust direction of the fourth thruster 12*d* is opposite to a third thrust direction of the third thruster 12*c*. However, since the first thrust force 36*a* and the third thrust force 36*c* are larger than the second thrust force 36*b* and the fourth thrust force 36*d*, respectively, the thrust forces 36 can compensate against the primary external force 34*a* to keep the vessel 10 stationary.

Since the thrusters 12 provide thrust forces 36 in opposite thrust directions, the energy consumption is higher in the directional bias mode 42*a* than in the normal mode 40. However, since a thrust force 36 can more quickly be decreased than increased and since the thrust force 36 is proportional to a propeller speed of the thruster 12 squared, the response of the vessel 10 is increased and the vessel 10 can react faster to variations in the magnitude of the primary external force 34*a*. The bias level of the directional bias mode 42*a* can for example be increased by increasing all thrust forces 36 and vice versa.

Figure 4:
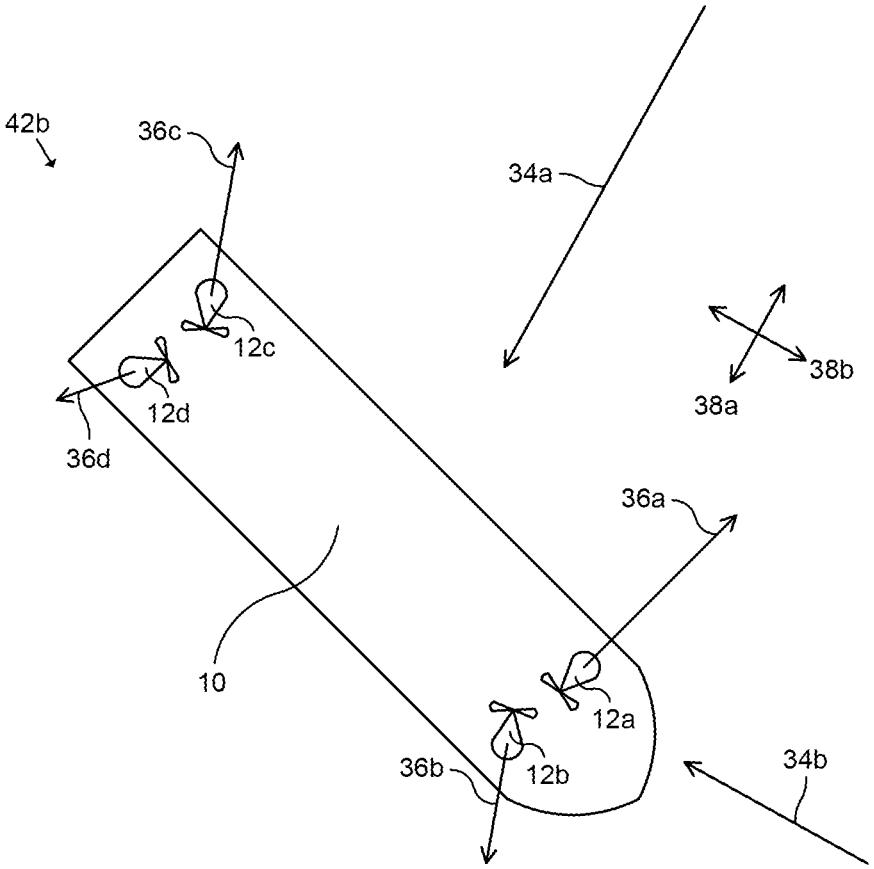
FIG. 4: schematically represents a top view of the vessel when operating in a non-directional bias mode.

FIG. 4 schematically represents a top view of the vessel 10 when operating in a non-directional bias mode 42*b*. The non-directional bias mode 42*b* is a further example of a bias mode according to the present disclosure. One or both of the bias modes 42*a*, 42*b* may also be referred to with reference numeral "42".

As shown, the vessel 10 is acted on not only by the primary external force 34*a* but also by a secondary external force 34*b*. The secondary external force 34*b* has a secondary direction in the secondary reference direction 38*b*. In FIG. 4, magnitudes of both the primary external force 34*a* and the secondary external force 34*b* vary. This circumstance constitutes a further example of an operational condition according to the present disclosure. The primary external force 34*a* may for example be a force from wind and the secondary external force 34*b* may for example be a force from waves. One or both external forces 34*a*, 34*b* may also be referred to with reference numeral "34".

In the non-directional bias mode 42*b*, the thrusters 12 provide thrust forces 36 partly in opposite thrust directions. Thus, the thrust forces 36 partly cancel out each other. In this specific and non-limiting example, each thruster 12 is positioned in a unique thrust direction and each thrust direction provides a thrust force 36 partly in the primary direction of the primary external force 34*a* and partly in the secondary direction of the secondary external force 34*b*. The thrust direction of the second thruster 12*b* is here angled between 90 degrees and 270 degrees to the thrust direction of the first thruster 12*a*. Correspondingly, the thrust direction of the fourth thruster 12*d* is here angled between 90 degrees and 270 degrees to the thrust direction of the third thruster 12*c*.

The thrusters 12 thus work against each other both in the primary direction and in the secondary direction. In this way, the thrusters 12 can compensate against both the primary external force 34*a* and the secondary external force 34*b* to keep the vessel 10 stationary. Variations of directions and magnitudes of any of the external forces 34 are mainly compensated by varying thrust forces 36, while thrust directions may be only slightly varied.

The non-directional bias mode 42*b* increases the responsiveness of the vessel 10 in both the primary reference direction 38*a* and in the secondary reference direction 38*b*. The bias level of the non-directional bias mode 42*b* can for example be increased by increasing all thrust forces 36 and vice versa.

A method of controlling the vessel 10 is implemented in the control system 14. The method comprises estimating, by the control system 14, the operational condition of the vessel 10. The method further comprises commanding, by the control system 14, execution of a countermeasure associated with an activation of the bias mode 42, a deactivation of the bias mode 42, or a change of a bias level of the bias mode 42.

In this example, the operational condition may be estimated based on the position data 24. To this end, historic, current and/or future position data 24 may be used. Moreover, algorithms may be applied to the position data 24 and any other sensor data. For example, future position data 24 may be estimated based on trends in historic position data 24 using an algorithm. If for example the vessel 10 oscillates in the primary reference direction 38*a*, as determined based on the position data 24, the control system 14 can, e.g., using the model 20, conclude that there is an external force 34 acting on the vessel 10 in the primary reference direction 38*a* with a certain magnitude and with a certain variation of the magnitude.

The control system 14 here uses the model 20 to determine the operational condition. The operational condition may be evaluated continuously or repeatedly. For example, based on deviations of a current position, e.g., as determined based on the position data 24, the control system 14 can determine a direction and a magnitude of one or more external forces 34 acting on the vessel 10.

The control system 14 may then evaluate the operational condition in view of one or more bias modes 42. For example, if the operational condition includes an external force 34 acting on the vessel 10 having a relatively low variation of direction and a relatively low variation of magnitude, as in FIG. 2, it may be considered that the operational condition does not meet any bias mode criterion and the normal mode 40 (i.e., deactivated bias mode 42) may be evaluated as most appropriate. For example, if the operational condition includes an external force 34 acting on the vessel 10 having a relatively low variation of direction but a relatively high variation of magnitude, as in FIG. 3, it may be considered that the operational condition meets a directional bias mode criterion associated with the directional bias mode 42*a* and the directional bias mode 42*a* may be evaluated as most appropriate. Thus, by knowing the direction of the external force 34, the magnitude of the external force 34, and variations thereof, a minimum of bias can be applied and can be adjusted as the external force 34 varies over time.

According to a further example, if the operational condition includes two external forces 34 acting on the vessel 10 in different directions and at least one of the external forces 34 has a variation of magnitude, as in FIG. 4, it may be considered that the operational condition meets a non-directional bias mode criterion associated with the non-directional bias mode 42*b* and the non-directional bias mode 42*b* may be evaluated as most appropriate. In order to make the evaluations, the control system 14 may for example use a look-up table, e.g., stored in the memory 18, that maps parameter intervals for the parameters magnitudes, variations of the magnitudes, directions, and variations of the directions, of the external forces 34, to either the normal mode 40, the directional bias mode 42*a* or the non-directional bias mode 42*b*. For the directional bias mode 42*a* and the non-directional bias mode 42*b*, the parameters may also be mapped to a certain bias level. The control system 14 thus automatically determines if the current operational condition requires activation of any of the directional bias mode 42*a* and the non-directional bias mode 42*b* or an increase of the bias level to improve performance, or if the current operational condition allows deactivation of any of the directional bias mode 42*a* and the non-directional bias mode 42*b* or a decrease of the bias level to reduce energy consumption.

The countermeasure may for example be an automatic activation or a deactivation of the directional bias mode 42*a* by the control system 14, or an automatic activation or a deactivation of the non-directional bias mode 42*b* by the control system 14. According to one further example, the countermeasure may be constituted by the notification 30 provided by the control system 14 to the human user 32 advising to manually activate or deactivate any of the directional bias mode 42*a* and the non-directional bias mode 42*b*, or to change a bias level, using the input device 28. In any case, the method enables an optimal use of the bias mode 42, leading to improved performance, reduced energy consumption and reduced wear and tear in comparison with when the human user 32 activates or deactivates the bias mode 42 based on a behavior of the vessel 10 as perceived by the human user 32. The method enables the bias mode 42 to be activated and deactivated at the right time and with a suitable bias level. The method for example reduces a risk of at the right time and reduces a risk of overlooking deactivation of the bias mode 42.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

The invention claimed is:

1. A method of controlling a vessel comprising a plurality of thrusters, where the vessel is configured to operate in a bias mode where at least two of the thrusters provide thrust forces at least partly in opposite thrust directions, the method comprising:

estimating, by a control system, an operational condition associated with the vessel, wherein the estimation of the operational condition includes estimating at least one parameter of one or more external disturbances acting on the vessel, wherein the at least one parameter comprises a direction and/or a variation of the direction; and commanding, by the control system and based on the estimation, execution of a countermeasure associated with an activation of the bias mode, a deactivation of the bias mode or a change of a bias level of the bias mode;

wherein the thrust forces partly in opposite thrust directions are higher at a relatively high bias level than at a relatively low bias level.

2. The method according to claim 1, wherein the at least one parameter further comprises a direction, a variation of the direction, a magnitude and/or a variation of the magnitude.

3. The method according to claim 1, wherein each external disturbance comprises an external force.

4. The method according to claim 1, further comprising providing, by the control system, a model of the vessel, wherein the estimation of the operational condition is made using the model.

5. The method according to claim 1, further comprising receiving, by the control system, sensor data from one or more sensors, wherein the estimation of the operational condition is made using the sensor data.

6. The method according to claim 5, further comprising storing the sensor data as historic sensor data, and wherein the estimation of the operational condition is made using the historic sensor data.

7. The method according to claim 1, further comprising determining the bias level based on the operational condition, wherein the countermeasure includes activating a control of the vessel in the bias mode at the determined bias level.

8. The method according to claim 1, wherein the countermeasure comprises a notification to a human user of the vessel.

9. A control system for controlling a vessel having a plurality of thrusters, where the vessel is configured to operate in a bias mode where at least two of the thrusters provide thrust forces at least partly in opposite thrust directions, the control system comprising at least one data processing device and at least one memory having at least one computer program stored thereon, the at least one computer program including program code which, when executed by the at least one data processing device, causes the at least one data processing device to:

estimate an operational condition associated with the vessel, wherein the estimation of the operational condition includes estimating at least one parameter of one or more external disturbances acting on the vessel, wherein the at least one parameter comprises a direction and/or a variation of the direction; and command based on the estimation, execution of a countermeasure associated with an activation of the bias mode, a deactivation of the bias mode or a change of a bias level of the bias mode;

wherein the thrust forces partly in opposite thrust directions are higher at a relatively high bias level than at a relatively low bias level.

10. A vessel comprising a control system for controlling a vessel including a plurality of thrusters, where the vessel is configured to operate in a bias mode where at least two of the thrusters provide thrust forces at least partly in opposite thrust directions, the control system including at least one data processing device and at least one memory having at least one computer program stored thereon, the at least one computer program including program code which, when executed by the at least one data processing device, causes the at least one data processing device to:

estimate an operational condition associated with the vessel, wherein the estimation of the operational condition includes estimating at least one parameter of one or more external disturbances acting on the vessel, wherein the at least one parameter comprises a direction and/or a variation of the direction;

command based on the estimation, execution of a countermeasure associated with an activation of the bias mode, a deactivation of the bias mode or a change of a bias level of the bias mode, and the plurality of thrusters;

wherein the thrust forces partly in opposite thrust directions are higher at a relatively high bias level than at a relatively low bias level.

11. The vessel according to claim 10, further comprising one or more sensors arranged to provide sensor data to the control system, wherein the estimation of the operational condition is made using the sensor data.

12. The vessel according to claim 11, wherein the at least one computer program comprises program code which, when executed by the at least one data processing device, causes the at least one data processing device to store the sensor data as historic sensor data, and wherein the estimation of the operational condition is made using the historic sensor data.

13. The method according to claim 2, wherein each external disturbance comprises an external force.

14. The method according to claim 2, further comprising providing, by the control system, a model of the vessel, wherein the estimation of the operational condition is made using the model.

15. The method according to claim 2, further comprising receiving, by the control system, sensor data from one or more sensors, wherein the estimation of the operational condition is made using the sensor data.

16. The method according to claim 2, further comprising determining the bias level based on the operational condition, wherein the countermeasure includes activating a control of the vessel in the bias mode at the determined bias level.

17. The method according to claim 2, wherein the countermeasure comprises a notification to a human user of the vessel.

* * * * *